US008761627B2

(12) United States Patent
Maruyama

(10) Patent No.: US 8,761,627 B2
(45) Date of Patent: Jun. 24, 2014

(54) HEATING APPARATUS AND IMAGE FORMING APPARATUS HAVING THE SAME

(75) Inventor: Yasuhiro Maruyama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 166 days.

(21) Appl. No.: 13/430,329

(22) Filed: Mar. 26, 2012

(65) Prior Publication Data

US 2012/0301171 A1 Nov. 29, 2012

(30) Foreign Application Priority Data

May 24, 2011 (JP) ..... 2011-115765

(51) Int. Cl.
*G03G 15/20* (2006.01)

(52) U.S. Cl.
USPC ..... 399/69

(58) Field of Classification Search
USPC ..... 399/67, 69
See application file for complete search history.

(56) References Cited

U.S. PATENT DOCUMENTS

| | | | | |
|---|---|---|---|---|
| 8,526,836 | B2 * | 9/2013 | Mitsuoka et al. | 399/69 |
| 2010/0209130 | A1 * | 8/2010 | Komoto | 399/69 |
| 2010/0316404 | A1 * | 12/2010 | Fukuzawa et al. | 399/69 |
| 2012/0230717 | A1 | 9/2012 | Suzuki et al. | |
| 2012/0230744 | A1 | 9/2012 | Maruyama et al. | |

FOREIGN PATENT DOCUMENTS

| | | | |
|---|---|---|---|
| JP | H08-297429 | A | 11/1996 |
| JP | H10-091037 | A | 4/1998 |
| JP | H10-213996 | A | 8/1998 |
| JP | 2002-116669 | A | 4/2002 |
| JP | 2002-182521 | A | 6/2002 |
| JP | 2002-278351 | A | 9/2002 |
| JP | 2004-191710 | A | 7/2004 |
| JP | 2005-012977 | A | 1/2005 |
| JP | 2007-047559 | A | 2/2007 |
| JP | 2011-064824 | A | 3/2011 |

OTHER PUBLICATIONS

Japan Patent Office, Notification of Reasons for Refusal for Japanese Patent Application No. 2011-115765 (counterpart to above-captioned patent application), mailed May 7, 2013.
Japan Patent Office, Notification of Reasons for Refusal for Japanese Patent Application No. 2011-115765 (counterpart to above-captioned patent application), mailed Jul. 16, 2013.

* cited by examiner

*Primary Examiner* — Sandra Brase
(74) *Attorney, Agent, or Firm* — Baker Botts L.L.P.

(57) ABSTRACT

A heating apparatus includes a heater, a current-feed switching circuit configured to switch turning-on/off of current-feeding from an AC power source to the heater, thereby feeding current from the AC power source to the heater at a predetermined current-feed ratio, a temperature detector configured to detect a heating temperature of the heater, and a current-feed controller configured to control the current-feed ratio of the current-feed switching circuit such that the detection temperature of the temperature detector falls within a target range. The current-feed controller performs at least one pair of ON lock current-feed control to fix the current-feed ratio to almost 100% in a first period and OFF lock current-feed control to fix the current-feed ratio to almost 0% in a second period every predetermined control period of the current-feed switching circuit.

17 Claims, 6 Drawing Sheets

HEATING APPARATUS AND IMAGE FORMING APPARATUS HAVING THE SAME

CROSS REFERENCE TO RELATED APPLICATION

This application claims priority from Japanese Patent Application No. 2011-115765 filed on May 24, 2011. The entire content of this priority application is incorporated herein by reference.

TECHNICAL FIELD

The present invention relates to a heating apparatus and an image forming apparatus having the heating apparatus, in particular, a technique of restraining occurrence of high frequency wave in the current feeding of the heating apparatus.

BACKGROUND

A conventional known heating apparatus switches turning-on/off of the current feeding from an AC power source to a heater of a heating apparatus to heat the heater at a predetermined current-feed ratio. As a conventional technique of restraining occurrence of high-frequency wave, in other word, harmonic current in current-feed of the heating apparatus, for example, a technique is known which turns on the current-feed by 100% when the heater temperature is less than a lower limit value, turns off the current-feed when the heater temperature is higher than an upper limit value, and a sine-wave alternating current (AC) is periodically turned on/off in synchronization with zero cross of a sine-wave AC when the heater temperature falls between the upper limit value and the lower limit value.

According to the conventional technique, high frequency wave occurring at turning-on/off of the sine-wave alternating current can be reduced. However, a standard value of a harmonic current in heaters has been recently become strict and therefore, in heating control of the heaters, a technique of further restraining the harmonic current has been demanded. For example, a method of further restraining the harmonic current by forcibly inserting a period of current-feed ratio of 100% or the current-feed ratio of 0%, during which the harmonic current hardly occurs, in current-feed control of the heaters can be considered. However, according to this method, a balance between restraint of the harmonic current and the control accuracy of the heating temperature of the heating apparatus is important. Thus, there has been a demand for keeping the control accuracy of the heating temperature while improving the effect of restraining the harmonic current.

The present invention provides a technique of keeping the predetermined control accuracy of the heating temperature while improving the effect of restraining the harmonic current in heating control of the heater.

SUMMARY

A heating apparatus disclosed in this specification includes a heater, a current-feed switching circuit configured to switch turning-on/off of current-feeding from an AC power source to the heater, thereby feeding current from the AC power source to the heater at a predetermined current-feed ratio, a temperature detector configured to detect a heating temperature of the heater, and a current-feed controller configured to control the current-feed ratio of the current-feed switching circuit such that the detection temperature of the temperature detector falls within a target range. The current-feed controller performs at least one pair of ON lock current-feed control to fix the current-feed ratio to almost 100% in a first period and OFF lock current-feed control to fix the current-feed ratio to almost 0% in a second period every predetermined control period of the current-feed switching circuit.

DETAILED DESCRIPTION OF THE ILLUSTRATIVE ASPECTS

Next, an illustrative aspect according to the present invention will be described with reference to FIGS. 1 to 6.

1. Configuration of Laser Printer

Figure 1:
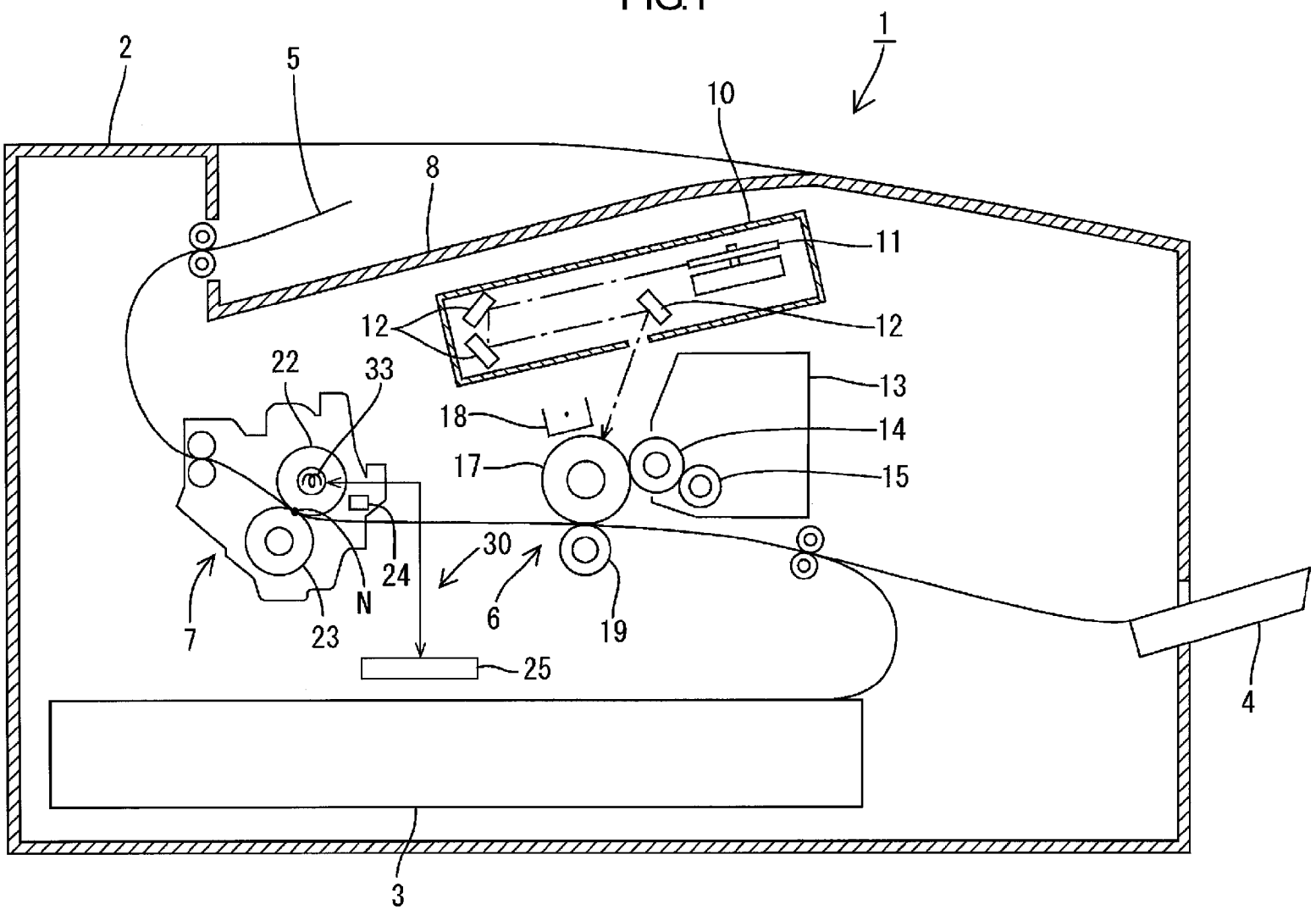
FIG. 1 is a side sectional view showing a schematic configuration of an image forming apparatus according to the one illustrative aspect.

FIG. 1 is a view schematically showing a vertical cross section of a monochrome laser printer 1 (an example of an "image forming apparatus") according to the one illustrative aspect. The image forming apparatus is not limited to the monochrome laser printer, and for example, may be a color laser printer, a color LED printer or a multiple function machine or the like.

In the monochrome laser printer (hereinafter referred to as a "printer") 1, an image forming unit 6 forms a toner image on a sheet 5 (an example of a recording medium) fed from a tray 3 or a tray 4, which is disposed in a lower portion of a body casing 2, and then, a fusing unit 7 heats the toner image to perform fusing treatment and finally, the sheet 5 is ejected to a sheet output tray 8 located in an upper portion of the body casing 2.

The image forming unit 6 includes a scanner unit 10, a developing cartridge 13, a photoconductive drum 17, an charging unit 18 and a transfer roller 19, and forms the toner image on the sheet 5.

The scanner unit 10 is disposed in the upper portion of the body casing 2 and includes a laser light emitting part (not shown), a polygon mirror 11, a plurality of reflecting mirrors 12 and a plurality of lenses (not shown) and the like. The scanner unit 10 irradiates the surface of the photoconductive drum 17 with laser light emitted from the laser light emitting part through the polygon mirror 11, the reflecting mirrors 12 and the lenses by high-speed scanning as represented by a dashed line.

The developing cartridge 13 is detachably attached to the body casing 2 and stores toner therein. A developing roller 14 and a feeding roller 15 are provided at a toner feeding port of the developing cartridge 13 as opposed to each other, and the developing roller 14 is also disposed as opposed to the photoconductive drum 17. The toner stored in the developing cartridge 13 is fed to the developing roller 14 with rotation of the feeding roller 15, and carried by the developing roller 14.

The charging unit 18 is disposed above the photoconductive drum 17 with an interval therebetween. The transfer roller 19 is disposed below the photoconductive drum 17 as opposed to the photoconductive drum 17.

While being rotated, the surface of the photoconductive drum 17 is charged uniformly, for example, positively charged by the charging unit 18. Next, an electrostatic latent image is formed on the photoconductive drum 17 by the laser light from the scanner unit 10, and then, the photoconductive drum 17 contacts with the developing roller 14 and rotates. At this time, the toner carried on the developing roller 14 is fed to the electrostatic latent image on the surface of the photoconductive drum 17 and carried thereon to form a toner image. After that, while the sheet 5 passes between the photoconductive drum 17 and the transfer roller 19, the toner image is transferred to the sheet 5 by transfer bias applied to the transfer roller 19.

The fusing unit (an example of a heating apparatus) 7 is disposed downstream from the image forming unit 6 in a sheet convey direction and includes a fusing roller (an example of the heater) 22, a pressure roller 23 for pressing the fusing roller 22 and a halogen heater (an example of the heater) 33 for heating the fusing roller 22. The halogen heater 33 is provided within the fusing roller 22 and is connected to a circuit board 25 for current-feed control according to a signal from the circuit board 25. Here, the fusing roller 22 and the halogen heater 33 constitute the heater. The sheet 5 is nipped at a position where the fusing roller 22 and the pressure roller 23 are opposed to each other and at the nip position (fusing position) N, the toner image is thermally fused to the sheet 5.

The configuration of the fusing unit 7 is not limited to this. For example, the fusing unit 7 may be a fusing unit of so-called film fusing type using a fusing film in place of the fusing roller 22. In this case, for example, the fusing film and a halogen lamp constitute the heater.

A temperature sensor (an example of a temperature detector) 24 that detects the temperature of the fusing roller 22 (heater) is provided in the vicinity of the fusing roller 22, and the temperature sensor 24 substantially detects the surface temperature of the fusing roller 22. That is, in this illustrative aspect, a detection temperature Tk of the temperature sensor 24 corresponds to the surface temperature of the fusing roller 22.

2. Electric Configuration of Heating Apparatus

Figure 2:
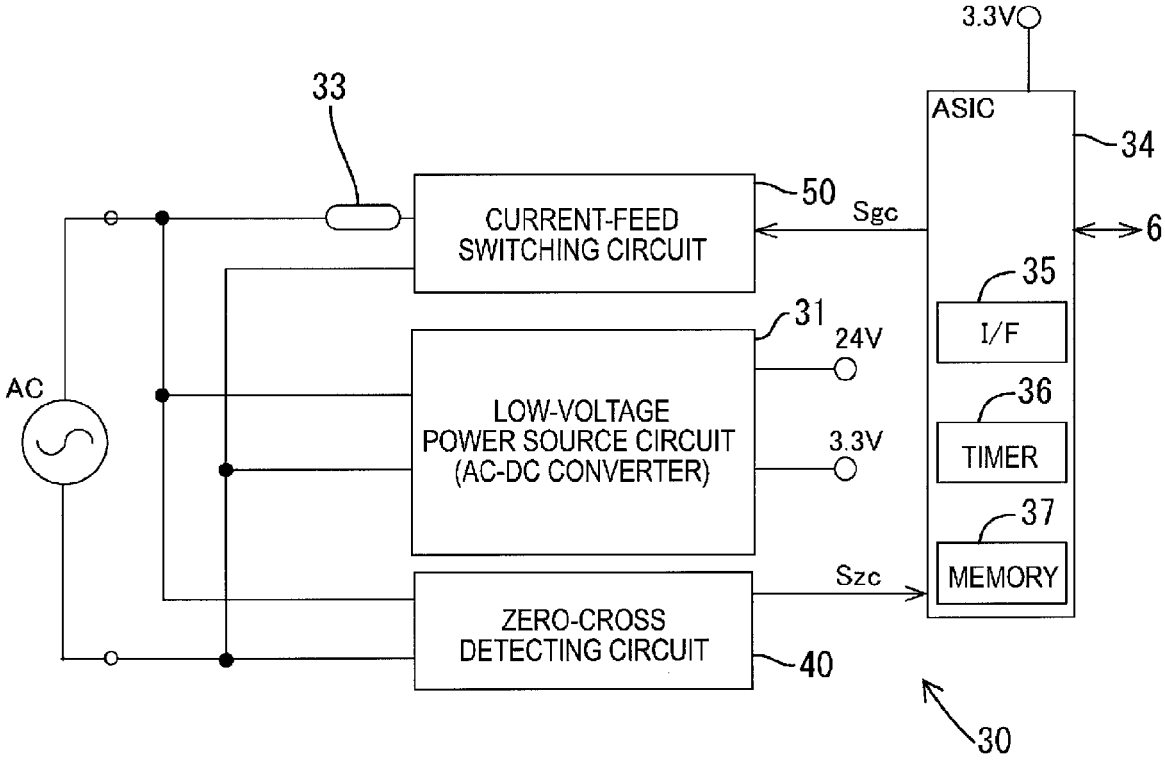
FIG. 2 is a block diagram showing a schematic configuration of a heating apparatus according to the one illustrative aspect.
Figure 3:
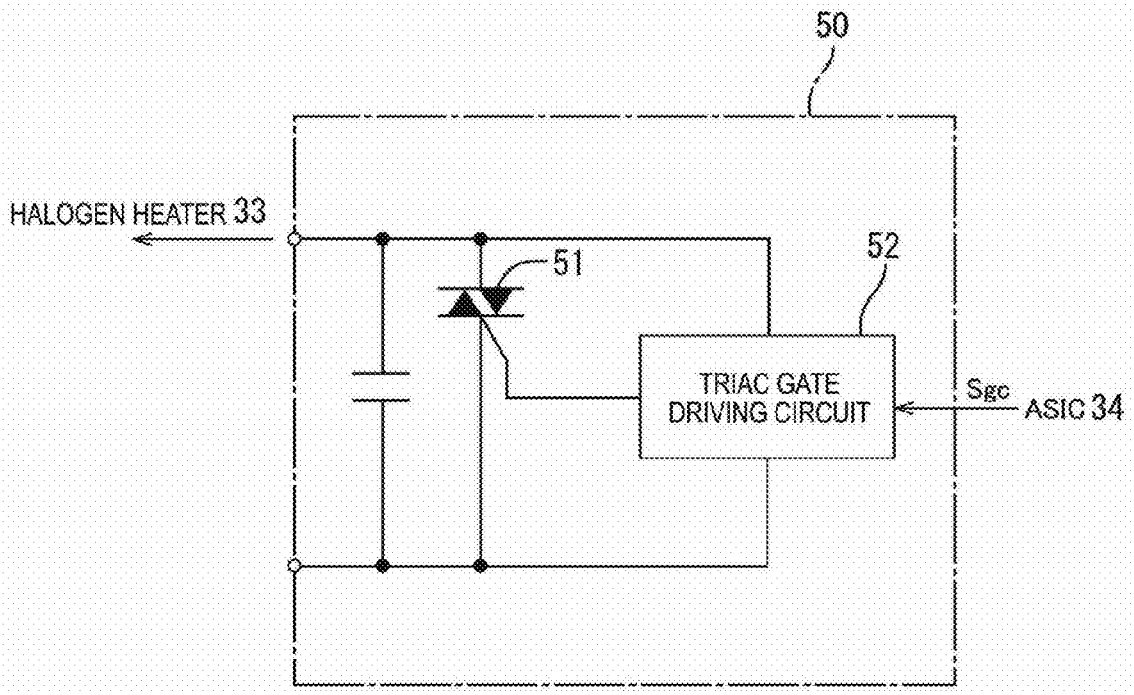
FIG. 3 is a block diagram showing a schematic configuration of a current-feed switching circuit of the heating apparatus.
Figure 4:
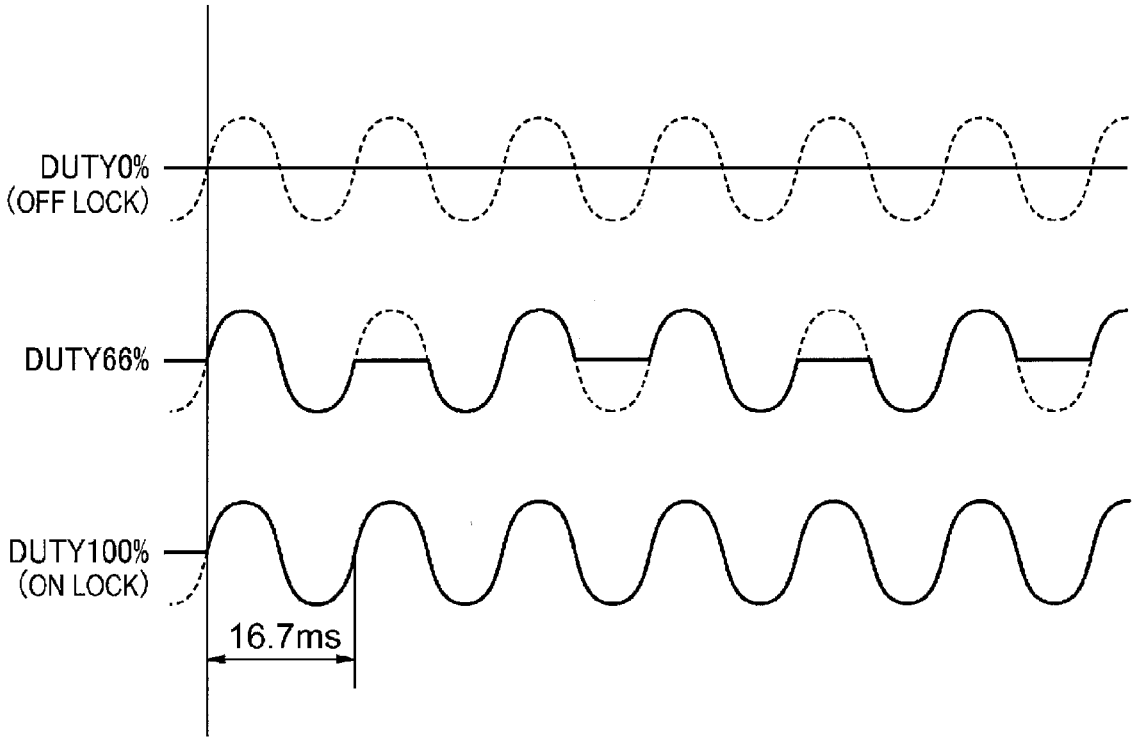
FIG. 4 is a graph showing a relationship between wave-number DUTY ratio and current-feed waveform.

Next, a heating apparatus 30 provided in the printer 1 will be described with reference to FIGS. 2 to 4. FIG. 2 is a block diagram showing a schematic configuration of the heating apparatus 30. FIG. 3 is a block diagram showing a schematic configuration of a current-feed switching circuit 50 of the heating apparatus 30. FIG. 4 is a graph showing a relationship between wave-number DUTY ratio and current-feed waveform (AC waveform).

The heating apparatus 30 includes a low-voltage power source circuit (AC-DC converter) 31, the halogen heater 33, an ASIC (Application Specific Integrated Circuit) 34, a zero cross detecting circuit 40 and the current-feed switching circuit 50 and the like. Here, each circuit except for the halogen heater 33 is provided on the circuit board 25. The low-voltage power source circuit 31 is not necessarily included in the heating apparatus 30.

The low-voltage power source circuit 31 converts, for example, an AC voltage of 100 V into a DC voltage of 24 V and 3.3 V and feeds the DC voltage to each part. The halogen heater 33 generates heat according to the current-feed from an AC power source AC.

The zero cross detecting circuit 40 generates a zero cross signal Szc in synchronization with a zero cross timing of the sine-wave alternating current power source (hereinafter referred to as AC power source) AC. The ASIC 34 controls the current feeding of the current-feed switching circuit 50 in synchronization with the zero cross signal Szc.

The current-feed switching circuit 50 switches turning-on/off of the current feeding from the AC power source AC to the halogen heater 33, thereby feeding current from the AC power source AC to the halogen heater 33 at a predetermined current-feed ratio. Specifically, as shown in FIG. 3, the current-feed switching circuit 50 includes, for example, a triac 51 and a triac gate driving circuit 52. The triac gate driving circuit 52 receives a gate control signal Sgc from the ASIC 34 and turns on/off the triac 51 according to the gate control signal Sgc, thereby switching the turning-on/off of the current feeding from the AC power source AC to the halogen heater 33.

The ASIC (an example of a current-feed controller) 34 includes an interface circuit 35, a timer 36 and a memory 37 and the like, and controls the current-feed switching circuit 50 to perform current-feed control of the fusing unit 7. The ASIC 34 is connected to the image forming unit 6 and also performs controls related to image formation. The interface circuit 35 mediates exchange of various data with the outside of the ASIC. The timer 36 is used to measure various current-feed times in current-feed control of the fusing unit 7. The memory 37 includes a ROM and a RAM. The configuration of the current-feed controller is not limited to the ASIC 34 and may be, for example, a CPU or discrete circuits.

The ASIC 34 controls the wave-number DUTY ratio of the current-feed switching circuit 50 such that the detection temperature (heating temperature) Tk of the temperature sensor 24 falls within a target range. In doing so, the ASIC 34 basically performs at least one pair of ON lock current-feed control to fix the wave-number DUTY ratio to almost 100% during a first period (hereinafter referred to as merely "ON lock") and OFF lock current-feed control to fix the wave-number DUTY ratio to almost 0% during a second period (hereinafter referred to as merely "OFF lock") every predetermined control period of the current-feed switching circuit 50.

Here, the wave-number DUTY ratio (hereinafter referred to as merely "DUTY ratio") is a DUTY ratio in the case of wave-number controlling the AC power source AC, and is an example of a current-feed ratio as a ratio of a current-feed time from the AC power source AC to the halogen heater 33 to a unit time. As shown in FIG. 4, at the DUTY ratio "0%", the current-feed from the AC power source AC is shut off and in an OFF state, and at the DUTY ratio of "100%", the current-feed from the AC power source AC is fully performed and in an ON state. At the DUTY ratio of "66%", for example, the current-feed from the AC power source AC is turned off almost in a half cycle of each 1.5 cycle. Since the triac 51 is not turned on/off in "ON lock" and "OFF lock," the harmonic current hardly occurs. For this reason, by inserting "ON lock" or "OFF lock" into a current-feed control period of the fusing unit 7 on a timely basis, the amount of the harmonic current occurring with current-feed control of the fusing unit 7 can be reduced.

The "DUTY ratio of almost 100%" includes DUTY ratio of 99% or 98%, and is not limited to the DUTY ratio of 100%. The "DUTY ratio of almost 0%" includes a DUTY ratio of 1% or 2% and is not limited to DUTY ratio of 0%.

3. Current-Feed Control of Heating Apparatus (Fusing Unit)

Figure 5:
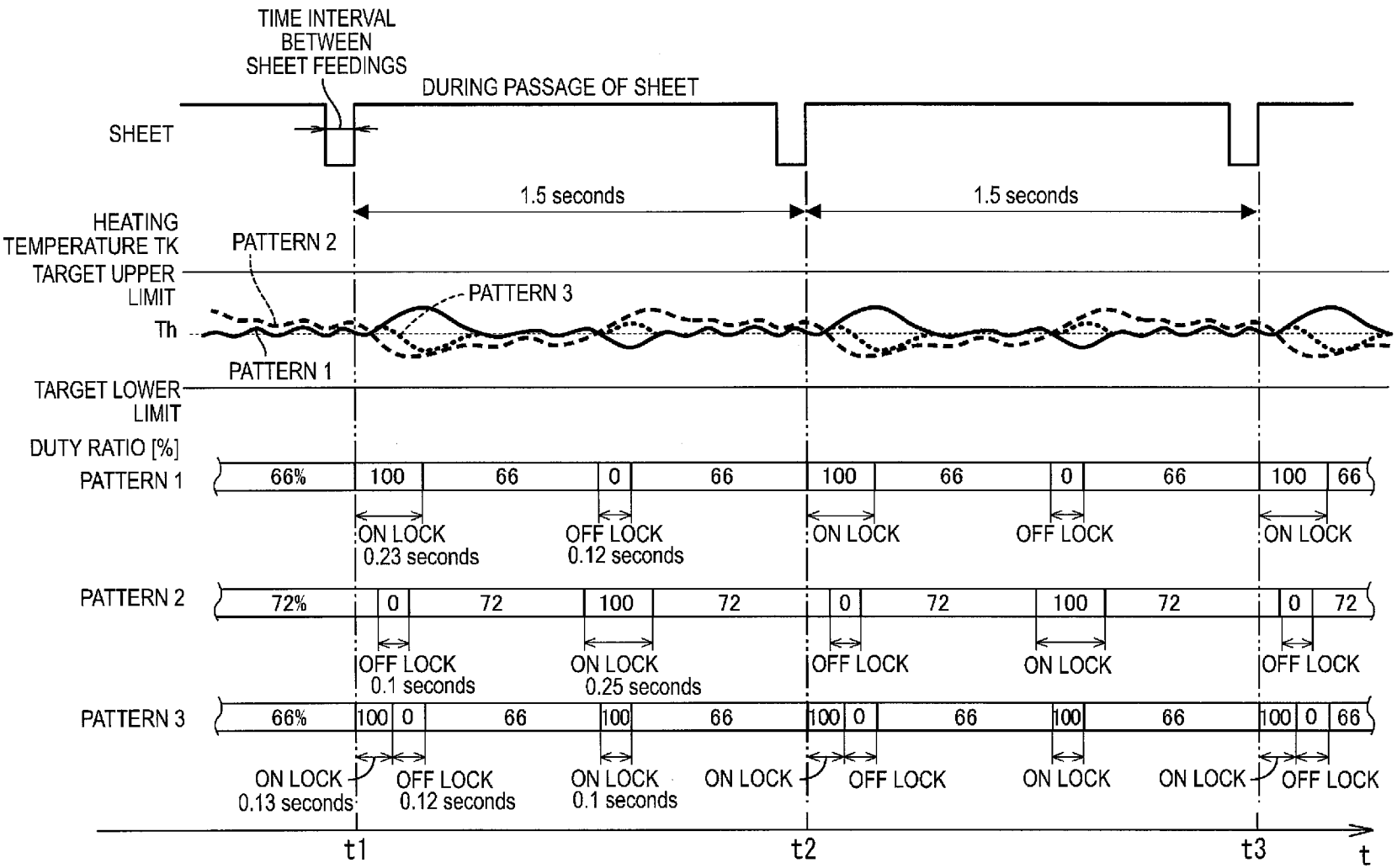
FIG. 5 is a timing chart showing a relationship between each DUTY ratio pattern and heating temperature.
Figure 6:
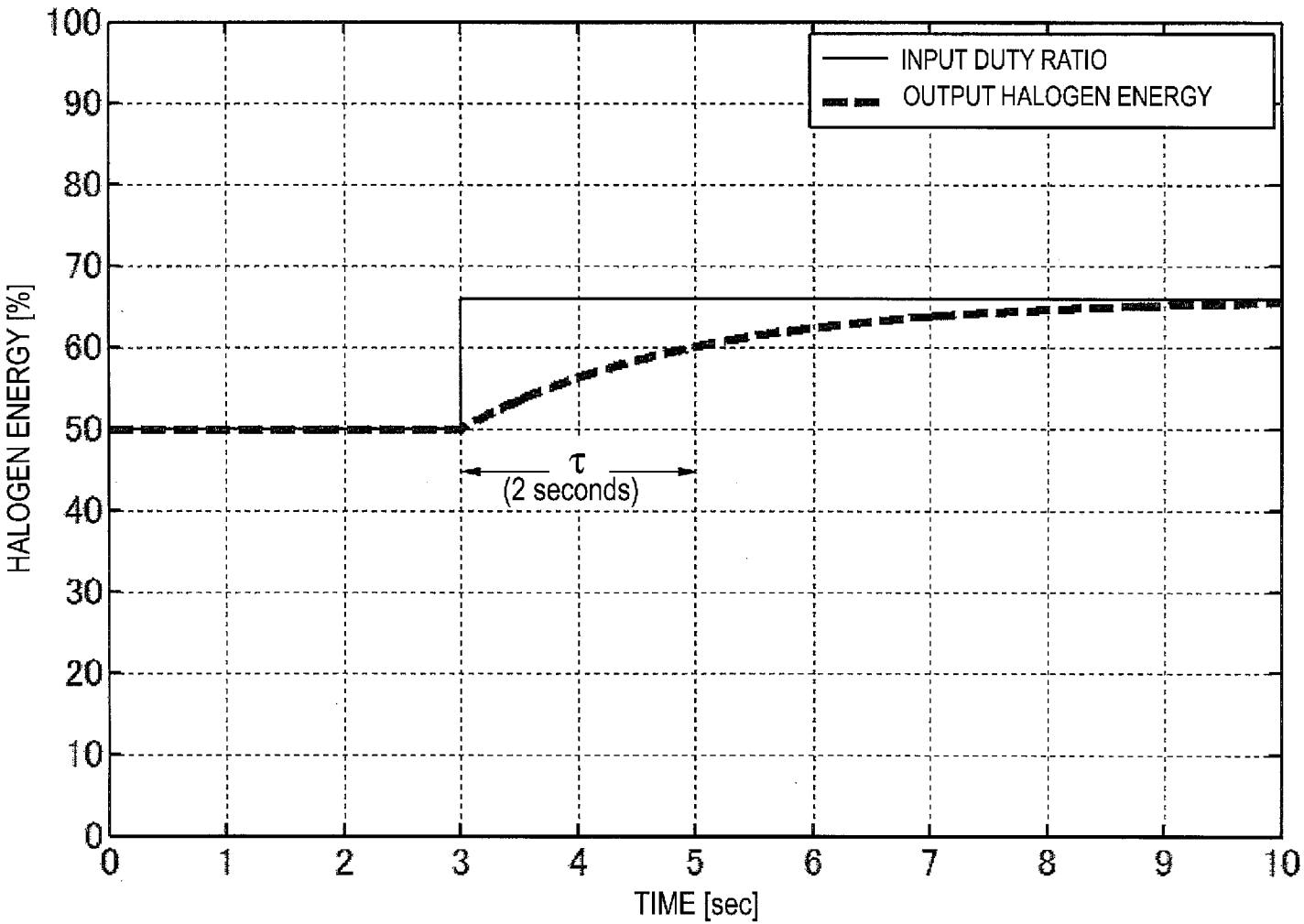
FIG. 6 is a graph showing a first-order lag of a heater output with respect to a DUTY ratio.

Next, current-feed control of the halogen heater 33 through the current-feed switching circuit 50 by the ASIC 34 will be described with reference to FIGS. 5 and 6. FIG. 5 is a timing chart showing a relationship between various types of current-feed control (DUTY ratio patterns) and the heating temperature Tk. FIG. 6 is a graph showing a first-order lag of an output (halogen energy) of the halogen heater 33 with respect to the DUTY ratio as a heater output instruction value. For example, the halogen energy rises toward a heater output of 66% with respect to the input DUTY ratio of 66% with the first-order lag.

Three types of patterns (1 to 3) of DUTY ratio control of the ASIC 34 will be described. In each of the DUTY ratio patterns (1 to 3), as described above, the ASIC 34 basically performs at least one pair of "ON lock" to fix the DUTY ratio to almost 100% in an "ON lock" period (corresponding to the first period) and "OFF lock" to fix the DUTY ratio to almost 0% in an "OFF lock" period (corresponding to the second period) every predetermined control period of the current-feed switching circuit 50.

Here, the predetermined control period is set to, as shown in FIG. 5, 1.5 seconds, and corresponds to a passage time during which the sheet 5 passes through the fusing unit 7, specifically, the nip part N, (hereinafter referred to as "sheet passage period"). It is assumed that sheet passage period includes a time interval between sheet feedings (time between sheets) in the case where the sheets 5 are continuously fused. Further, as shown in FIG. 6, a thermal time constant $\tau$ of the heater (the fusing roller 22 and the halogen heater 33) in this illustrative aspect is about 2 seconds, and the predetermined control period is set to be equal to or smaller than the thermal time constant $\tau$. The reason why the predetermined control period is set to be equal to or smaller than the thermal time constant is as follows: it is expected that the influence of a preceding lock period which is one of the pair of lock periods of "ON lock" and "OFF lock" on the temperature control is cancelled by the other lock period. For this reason, it is preferable to provide the other lock period during a period when the influence of the preceding lock period remains due to the first-order lag, that is, within the range of the thermal time constant $\tau$. As is well known, the thermal time constant $\tau$ is obtained by multiplying thermal capacity by thermal resistance of the heater, and is determined according to a previous experiment on temperature change in the heater and the like.

The predetermined control period is preferably equal to or smaller than the thermal time constant $\tau$ and is not limited to the sheet passage period. Further, the predetermined control period is not necessarily equal to or smaller than the thermal time constant $\tau$.

In each of the DUTY ratio patterns (1 to 3), the ASIC 34 controls the current-feed switching circuit 50 such that the current-feed ratio becomes a steady current-feed ratio which means a substantially constant current-feed ratio after the heating temperature Tk reaches a predetermined temperature. The "ON lock" period and the "OFF lock" period are set based on the "steady DUTY ratio" (corresponding to the steady current-feed ratio). In this illustrative aspect, a ratio of the "ON lock" period to a sum of the "ON lock" period and the "OFF lock" period is set to be equal to the "steady DUTY ratio."

3-1. Pattern 1

In the pattern 1, the "steady DUTY ratio" is set to 66%. The "ON lock" period is set to 0.23 seconds, and the "OFF lock" period is set to 0.12 seconds. That is, the sum of the "ON lock" period and the "OFF lock" period is 0.35 seconds (350 milliseconds), the ratio of the "ON lock" period to the sum (0.23/0.35) is about 0.66, which is equal to the "steady DUTY ratio." The ratio of the sum (0.35 seconds) to the sheet passage period (1.5 seconds) is appropriately set based on a balance between a measure against the harmonic current in the fusing unit and the influence on the temperature control of the fusing unit.

In the pattern 1, during each sheet passage period of 1.5 seconds, the "ON lock" period is provided at the beginning of the sheet passage period (t1, t2, t3) and the "OFF lock" period is provided substantially at the midpoint of the sheet passage period. A change in the heating temperature Tk in the pattern 1 is represented by a solid line in FIG. 5.

3-2. Pattern 2

In the pattern 2, the "steady DUTY ratio" is set to 72%. Accordingly, the "ON lock" period is set to 0.25 seconds, and the "OFF lock" period is set to 0.1 seconds. That is, the sum of the "ON lock" period and the "OFF lock" period is 0.35 seconds (350 milliseconds) as in the pattern 1, and the ratio of the "ON lock" period to the sum (0.25/0.35) is about 0.72, which is equal to the "steady DUTY ratio."

In the pattern 2, during each sheet passage period of 1.5 seconds, the "OFF lock" period is provided after a lapse of 0.1 seconds from the beginning of the sheet passage period (t1, t2, t3), and the "ON lock" period is provided substantially at the midpoint of the sheet passage period. That is, in the pattern 2, during each sheet passage period, "ON lock" and "OFF lock" are performed in the reverse order to the order in the pattern 1. A change in the heating temperature Tk in the pattern 2 is represented by a broken line in FIG. 5.

3-3. Pattern 3

In the pattern 3 as in the pattern 1, the "steady DUTY ratio" is set to 66%, the "ON lock" period is set to 0.23 seconds, and the "OFF lock" period is set to 0.12 seconds. This patter is different from the pattern 1 in an inserting manner of the "ON lock" period and the "OFF lock" period during each sheet passage period. That is, in the pattern 3, during each sheet passage period of 1.5 seconds, the "ON lock" period of 0.13 seconds is provided at the beginning of the sheet passage period and is continuously followed by the "OFF lock" period. Then, the "ON lock" period of 0.1 seconds is provided substantially at the midpoint of the sheet passage period.

As described above, in the pattern 3, during each sheet passage period, the "ON lock" period and the "OFF lock" period are continuously provided. By continuously performing "ON lock" and "OFF lock," an increase in the heating temperature Tk due to "ON lock" can be preferably restrained by the continued "OFF lock." Otherwise "OFF lock" may be continuously followed by "ON lock."

During each sheet passage period, the "ON lock" period are separately provided twice. That is, a pair of the "ON lock" period and the "OFF lock" period is provided and the "ON lock" period is further provided once. "ON lock" may be separately performed twice during the sheet passage period such that a ratio of the sum of "ON lock" periods during the sheet passage period is equal to the "steady DUTY ratio." A change in the heating temperature Tk in the pattern 3 which is different from the pattern 1 is represented by a dotted line in FIG. 5.

Inventors confirmed, as shown in FIG. 5, according to an experiment, the heating temperature Tk could be controlled to fall within a desired target temperature range from a target lower limit value to a target upper limit value while suppressing occurrence of the harmonic wave within a specified range in each of the DUTY ratio patterns (1 to 3). That is, inventors confirmed that irrespective of the inserting pattern of "ON lock" and "OFF lock" during the sheet passage period, the heating temperature Tk could be controlled to fall within the desired target temperature range by setting the ratio of the "ON lock" period to the sum of the "ON lock" period and the "OFF lock" period to be equal to the "steady DUTY ratio"

and performing at least one pair of "ON lock" and "OFF lock" during each sheet passage period.

The DUTY ratio pattern is not limited to the above-mentioned patterns (1 to 3), and various patterns can be adopted as long as following conditions: (1) at least one pair of "ON lock" and "OFF lock" are performed during each predetermined control period, and (2) the "ON lock" period and the "OFF lock" period are set such that the ratio of the "ON lock" period to the sum of the "ON lock" period and the "OFF lock" period is equal to the "steady DUTY ratio" are satisfied. The condition (2) may be omitted.

4. Effects of Illustrative Aspect

The ASIC 34 performs at least one pair of "ON lock" and "OFF lock" every sheet passage period (predetermined control period). By performing "ON lock" and "OFF lock" every sheet passage period in this manner, the influence of each "lock" control on the heating control can be cancelled and the heating temperature Tk can be controlled to fall within the target temperature range. Thus, it is possible to improve the effect of suppressing the harmonic current in heating control while keeping the accuracy of heating control of the heater.

During each sheet passage period, the ratio of the "ON lock" period to the sum of the "ON lock" period and the "OFF lock" period is set to be equal to the steady DUTY ratio. By setting the ratio of the "ON lock" period in this manner, an average DUTY ratio during each sheet passage period becomes equal to the steady DUTY ratio. That is, during each sheet passage period, even when "ON lock" and "OFF lock" are performed to restrain the harmonic current, since the average DUTY ratio during each sheet passage period becomes equal to the steady DUTY ratio, the influence of insertion of "ON lock" and "OFF lock" on heating control can be restrained and the heating temperature Tk can be preferably controlled to fall within the target temperature range.

Each predetermined control period during which "ON lock" and "OFF lock" are performed is equal to or smaller than the thermal time constant $\tau$ of the heater and is defined as the sheet passage period. By defining the sheet passage period during which each sheet 5 is fused as the predetermined control period, the toner image can be fused on each sheet 5 under an almost uniform temperature condition.

Other Illustrative Aspects

The present invention is not limited to the illustrative aspect described in the above description and figures, and for example, following illustrative aspects falls within the technical scope of the present invention.

(1) In the above-mentioned illustrative aspect, the "ON lock" period (first period) and the "OFF lock" period (second period) may be set such that the ratio of the "ON lock" period to the sum of the "ON lock" period and the "OFF lock" period is equal to the steady DUTY ratio (steady current-feed ratio) taking into consideration of the first-order lag.

That is, generally, according to an equation using a thermal equivalent circuit, relationship between a control input (instruction value: DUTY ratio) and an output taking into consideration of the first-order lag (temperature of the heater) is represented by a following equation.

$$\text{Output}=a*\text{Outputold}+(1-a)*\text{Input}$$

where $a=\exp(-dt/\tau)$, dt: time step (sampling cycle)

$\tau$: thermal time constant of the heater (thermal capacity*thermal resistance)

Input: control input (instruction value: DUTY ratio)

Output: output taking into consideration of the first-order lag (temperature of the heater)

Outputold: Output value in immediately preceding 1 (one) time step (dt)

Since the first-order lag actually exists, and as shown in FIG. 6, the influence of the DUTY ratio as the instruction value (output halogen energy) appears late, use of the value of the DUTY ratio in consideration of this lag represents the actual condition well. For example, as shown in FIG. 6, in the case where the instruction DUTY ratio is switched from 50% to 66% at a timing of 3 seconds in FIG. 6, for example, when the lock ratio is calculated and instructed at a timing of 6 seconds in FIG. 6, it is more suitable to set the instruction DUTY ratio to 63% than to 66%.

(2) According to each of the above-mentioned illustrative aspects, in current-feed control of the fusing unit 7, the wave-number duty ratio is used as the current-feed ratio to perform wave-number control of the AC power source (in other word, alternating current). However, the present invention is not limited to this. The present invention can be applied to the case where, in current-feed control of the fusing unit 7, a phase duty ratio is used as the current-feed ratio to perform phase control of the alternating current.

(3) In the above-mentioned illustrative aspect, the heating apparatus 30 is applied to the fusing unit 7 of the printer 1. However, the present invention is not limited to this. The heating apparatus according to the present invention can be also applied to any apparatus desiring improvement of restraint of the harmonic current in the heating control while keeping the accuracy of the heating control.

What is claimed is:

1. A heating apparatus comprising:

a heater;

a current-feed switching circuit configured to switch turning-on/off of current-feeding from an AC power source to the heater, thereby feeding current from the AC power source to the heater at a current-feed ratio, the current-feed switching circuit being further configured to perform ON lock current-feed control in which a current-feed ratio is fixed to almost 100%, OFF lock current-feed control in which the current-feed ratio is fixed to almost 0%, and predetermined current-feed control in which the current is fed at a predetermined current-feed ratio that is different from almost 100% and almost 0%;

a temperature detector configured to detect a heating temperature of the heater; and a current-feed controller configured to control the current-feed ratio of the current-feed switching circuit such that the detection temperature of the temperature detector is within a target range, the current-feed controller being further configured to perform the ON lock current-feed control for a first period, the OFF lock current-feed control for a second period, and the predetermined current-feed control for a third period, such that each of the ON lock current-feed control, the OFF lock current-feed control, and the predetermined current-feed control is performed at least once, each at a different timing, within a predetermined control period.

2. The heating apparatus according to claim 1, wherein the predetermined control period is set to be equal to or smaller than a thermal time constant of the heater.

3. The heating apparatus according to claim 1, wherein the current-feed controller performs the ON lock current-feed control and the OFF lock current-feed control successively.

4. The heating apparatus according to claim 3, wherein the current-feed controller performs successive processing of the ON lock current-feed control and the OFF lock current-feed control at a beginning of the predetermined control period.

5. The heating apparatus according to claim 4, wherein the current-feed controller controls the current-feed switching circuit such that the current-feed ratio is set to the predetermined current-feed ratio after the heating temperature reaches the target temperature range, the predetermined current-feed ratio being substantially constant, and the first period and the second period are set based on the predetermined current-feed ratio.

6. The heating apparatus according to claim 1, wherein:

the current-feed controller controls the current-feed switching circuit such that the current-feed ratio is set to the predetermined current-feed ratio after the heating temperature reaches the target temperature range, the predetermined current-feed ratio being substantially constant; and the first period and the second period are set based on the predetermined current-feed ratio.

7. The heating apparatus according to claim 6, wherein the first period and the second period are set such that a ratio of the first period to a sum of the first period and the second period is equal to the predetermined current-feed ratio.

8. The heating apparatus according to claim 6, wherein the first period and the second period are set such that a ratio of the first period to a sum of the first period and the second period is equal to the predetermined current-feed ratio taking into consideration of a first-order lag.

9. An image forming apparatus comprising:

an image forming unit configured to form a toner image on a recording medium; and the heating apparatus according to claim 1 as a fusing unit that fuses the toner image formed on the recording medium on the recording medium.

10. An image forming apparatus comprising:

an image forming unit configured to form an image on a recording medium;

a fusing unit including a heater and configured to fuse the image on the recording medium when the recording medium passes;

a current-feed switching circuit configured to switch turning-on/off of current-feeding from an AC power source to the heater, thereby feeding current from the AC power source to the heater at a current-feed ratio, the current-feed switching circuit being further configured to perform ON lock current-feed control in which a current-feed ratio is fixed to almost 100%, OFF lock current-feed control in which the current-feed ratio is fixed to almost 0%, and predetermined current-feed control in which the current is fed at a predetermined current-feed ratio that is different from almost 100% and almost 0%;

a temperature detector configured to detect a heating temperature of the heater; and a current-feed controller configured to control the current-feed switching circuit such that a detection temperature of the temperature detector is within a target range by changing the current-feed ratio, the current-feed controller being further configured to: perform the ON lock current-feed control for a first period, perform the OFF lock current-feed control for a second period, and perform the predetermined current-feed control for a third period, such that each of the ON lock current-feed control, the OFF lock current-feed control, and the predetermined current-feed control is performed at least once, each at a different timing, within a predetermined control period.

11. The image forming apparatus according to claim 10, wherein the predetermined control period is set to be equal to or smaller than a thermal time constant of the heater.

12. The image forming apparatus according to claim 10, wherein the predetermined control period is a passage time during which a sheet of the recording medium passes through the fusing unit.

13. The image forming apparatus according to claim 10, wherein the current-feed controller performs the ON lock current-feed control and the OFF lock current-feed control successively.

14. The image forming apparatus according to claim 10, wherein:

the current-feed controller controls the current-feed switching circuit such that the current-feed ratio is the predetermined current-feed ratio which is substantially constant after the heating temperature reaches a predetermined temperature; and the first period and the second period are set based on the predetermined current-feed ratio.

15. The image forming apparatus according to claim 14, wherein the first period and the second period are set such that a ratio of the first period to a sum of the first period and the second period is equal to the predetermined current-feed ratio.

16. The image forming apparatus according to claim 14, wherein the first period and the second period are set such that a ratio of the first period to a sum of the first period and the second period is equal to the predetermined current-feed ratio taking into consideration of a first-order lag.

17. A heating apparatus comprising:

a heater;

a current-feed switching circuit configured to switch turning-on/off of current-feeding from an AC power source to the heater, thereby feeding current from the AC power source to the heater at a current-feed ratio, the current-feed switching circuit being further configured to perform ON lock current-feed control in which a current-feed ratio is fixed to almost 100%, OFF lock current-feed control in which the current-feed ratio is fixed to almost 0%, and predetermined current-feed control in which the current is fed at a predetermined current-feed ratio that is different from almost 100% and almost 0%;

a temperature detector configured to detect a heating temperature of the heater; and a current-feed controller configured to control the current-feed ratio of the current-feed switching circuit such that the detection temperature of the temperature detector is within a target range, the current-feed controller being further configured to perform: the ON lock current-feed control for a first period, the OFF lock current-feed control for a second period, and the predetermined current-feed control for a third period, such that each of the ON lock current-feed control, the OFF lock current-feed control, and the predetermined current-feed control is performed at least once within a predetermined control period.

* * * * *